US008245957B2

(12) United States Patent
Zhang

(10) Patent No.: US 8,245,957 B2
(45) Date of Patent: Aug. 21, 2012

(54) FLEXIBLE SPRAY NOZZLE FOR HIGH PRESSURE WASHERS

(75) Inventor: Da Quan Zhang, Taicang (CN)

(73) Assignee: Power Plus Products Ltd., Hong Kong (HK)

( * ) Notice: Subject to any disclaimer, the term of this patent is extended or adjusted under 35 U.S.C. 154(b) by 40 days.

(21) Appl. No.: 12/732,526

(22) Filed: Mar. 26, 2010

(65) Prior Publication Data

US 2011/0233304 A1 Sep. 29, 2011

(51) Int. Cl.
*B05B 15/08* (2006.01)
*B05B 15/06* (2006.01)

(52) U.S. Cl. ..... 239/587.5; 239/532

(58) Field of Classification Search ..... 239/525, 239/526, 530, 532, 578, 587.1, 587.5, 587.6
See application file for complete search history.

(56) References Cited

U.S. PATENT DOCUMENTS

| | | | | | |
|---|---|---|---|---|---|
| 746,110 | A * | 12/1903 | Lasher | 239/525 |
| 1,511,361 | A * | 10/1924 | Paasche | 239/415 |
| 1,745,972 | A * | 2/1930 | Beck | 239/532 |
| 2,857,201 | A * | 10/1958 | Palmer | 239/281 |
| 4,323,196 | A * | 4/1982 | Logue et al. | 239/532 |
| 6,685,115 | B1 * | 2/2004 | Hardin | 239/587.1 |
| 6,976,644 | B2 * | 12/2005 | Troudt | 239/587.1 |
| 2007/0170288 | A1 * | 7/2007 | Troudt et al. | 239/587.5 |
| 2011/0017846 | A1 | 1/2011 | Baxter et al. | |

* cited by examiner

*Primary Examiner* — Darren W Gorman
(74) *Attorney, Agent, or Firm* — Byrne Poh LLP

(57) ABSTRACT

A swivel nozzle mechanism used with a high pressure fluid washer attaches to an output wand, typically through a flexible hose, to direct a high pressure fluid from the washer to a directed target. The swivel nozzle mechanism attaches to a distal end of the wand and is controllable by a handle mechanism attached to the wand which enables the rotation of a spray nozzle about an axis, normal to the wand axis, at the distal end of the wand. The handle controls the direction of rotation of the spray nozzle and has a plurality of stable operating points resistant to movement and thereby providing for prolonged use at a fixed position.

7 Claims, 5 Drawing Sheets

SECTION A-A

FLEXIBLE SPRAY NOZZLE FOR HIGH PRESSURE WASHERS

BACKGROUND OF THE INVENTION

The invention relates to high pressure fluid washers, and more particularly, to the control of the spray nozzle direction for directing the output of such a fluid washer to a desired target direction.

High pressure washers are well-known in the industry. They develop water pressures on the order of, at the high end, 2000 to 3000 psi. It is important to direct this high-pressure fluid in an appropriate manner in order to effectively use the power of the washer. As a result, various spray nozzles have been developed for the washers which have the ability to vary the flow and direction of the fluid spray either in a continuous automatic manner or under manual (human) control.

SUMMARY OF THE INVENTION

Accordingly, the invention relates to a flexible spray accessory which can be manually controlled through a mechanical linkage in order to direct and output spray in a selected direction, as required, for directing the spray nozzle at and/or across an area to be targeted.

The invention thus relates to a swivel nozzle mechanism for use with a high pressure fluid washer, the washer having an output wand connected through a hose to a fluid output of the washer. In one illustrative embodiment, the invention has a handle mechanism connecting to the wand near an output end thereof, for moving an axial lever linkage in the general direction of a wand axis. Further, a swivel mechanism connecting to an output end of the wand, the swivel mechanism has a rotatable nozzle having an axis of rotation; a rotation inducing structure integral with the rotatable nozzle, the inducing structure having an off axis connection to the axial lever linkage; and a support base connected to the wand and supporting the rotatable nozzle, and providing a fluid flow path from a wand output orifice to the nozzle. The handle mechanism has a fixed support structure connected to the wand; a rotatable hub rotatably secured to the support structure; the axial lever linkage rotatably connecting to the rotatable hub of the handle mechanism through a rotatable axle; the axle having a rotatable connection with the hub and connected to the lever linkage to enable lever linkage movement about an axis normal to a lever linkage axis; the hub being rotatable about a hub axis normal to a wand axis; and a handle connected to the hub, the handle being able to rotate the hub about the hub axis for a limited rotational extent, thereby to rotate the hub about said hub axis by the same rotational extent. The fixed support structure connects to the wand in a fixed orientation, the rotatable hub has a plurality of stops; and a handle retention mechanism for enabling the handle to be maintained in a selectable rotational position using said stops, resistant to forces attempting to cause the handle to rotate. Thereby, rotational movement of said handle about said hub axis causes the lever linkage mechanism to move in a direction to cause the rotatable nozzle to rotate about its axis of rotation.

DESCRIPTION OF EMBODIMENTS OF THE INVENTION

Figure 1:
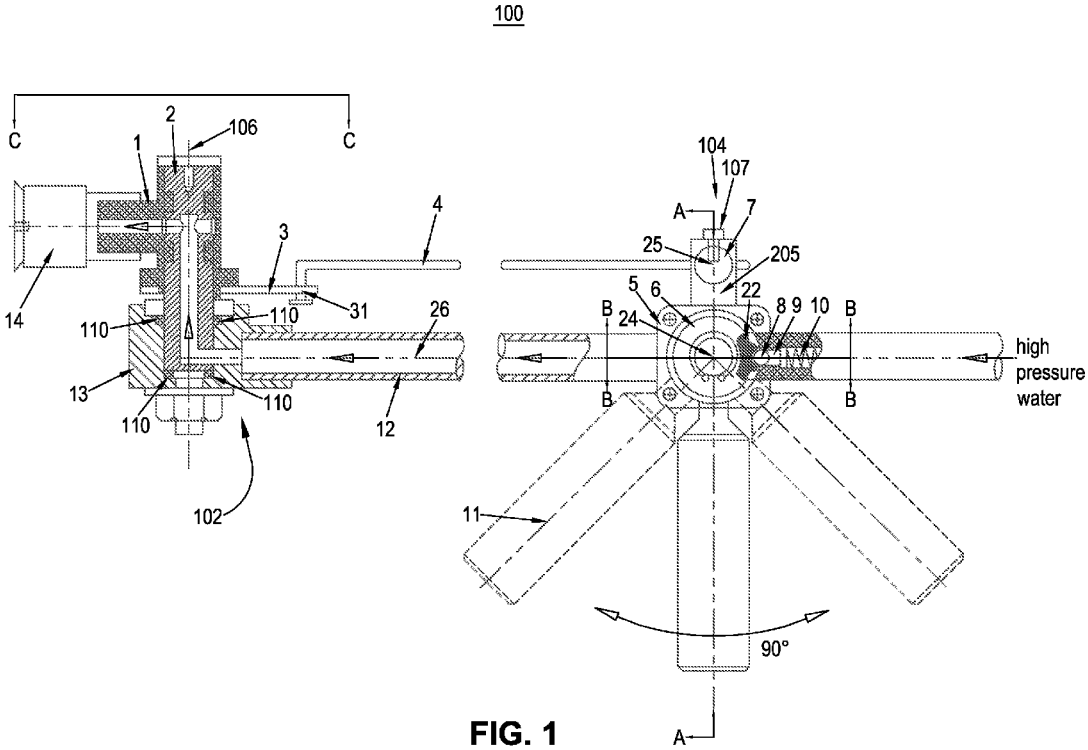
FIG. 1 is a cross-sectional view showing the mechanical construction of the spray system in accordance with one embodiment of the invention.

Referring to FIG. 1, in a first embodiment of the invention, a flexible spray system 100 is an accessory for a high pressure typically, but not necessarily, metallic wand 12 used with high pressure washers. The spray system features a spray nozzle which can be pivoted in an up-down or left-right direction depending on the orientation of the wand, to suit the purpose of a user's application. It is very useful for cleaning curved surfaces, dead angles, the bottom of a car or truck, and other difficult-to-reach areas. The spray system 100 of the invention enhances the functions that a pressure washer can perform, and can save labor, while achieving a better cleaning effect.

The flexible spray system 100 is installed at the outlet end of the typically metallic wand 12 of a high pressure water gun used with high pressure washers. Often a flexible connecting hose is used between the wand and the washer. The spray system has a retractable spray nozzle section 102 which has a swinging plate 3 and a swinging or rotating spray nozzle 1. The direction of motion of the swinging spray nozzle is controlled primarily, in the illustrated embodiment, by a lever linkage, here having the swinging plate 3 and a lever 4, and operated by a handle section 104.

In operation, a user, with one hand, presses a trigger (not shown) on the gun to initiate the spray, and with the other hand, the user holds and turns or pivots a handle 11 to control the spray direction of the spray nozzle 1. The user turns the handle 11 to rotate a rotatable plate or hub 5 around an axle 6 of the fixed support structure to pull or push the lever 4, which then rotates the swinging plate 3 to rotational positions around axis 106 of an integral support structure which includes an axle core 2. This enables the pressure washer to clean many hard-to-reach areas in a highly efficient manner as the nozzle 1 rotates around axis 106 of core 2, fixed to plate 3.

Figure 3:
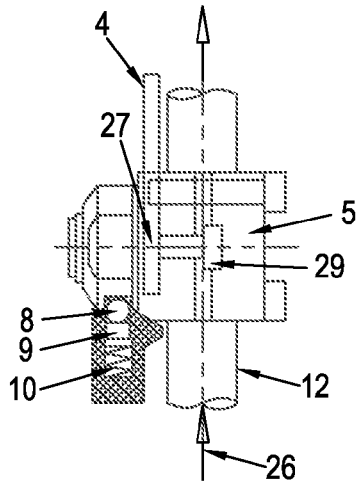
FIG. 3 is a cross-sectional view taken along lines B-B of FIG. 1.

The lever 4 is fixed to an axle 7 by, for example, a screw 107. Axle 7 rotates about axis 25 within a cylindrical opening in a handle extension 205 of plate 5. Plate 5 connects to the assist handle 11. The assist handle 11 has a range of rotation of about 90° in the illustrated embodiment, about an axis 24 of the axle 6. There are, in this illustrated embodiment, five concave indents 22 (three are illustrated) evenly spaced, rotationally, and located in a section of a circle in the outer cylindrical circumference of plate 5 to fix the physical rotational stability of the handle. The positional rotational stability is effected using a spring loaded ball 8, for example a steel ball, forced by a spring 10 toward and into the indents 22 through a core mandrel 9 (See also FIG. 3) integral with plate 5. This provides resistance to rotational movement of the handle 11, and effectively fixes the positional angle of the plate 5.

Figure 2:
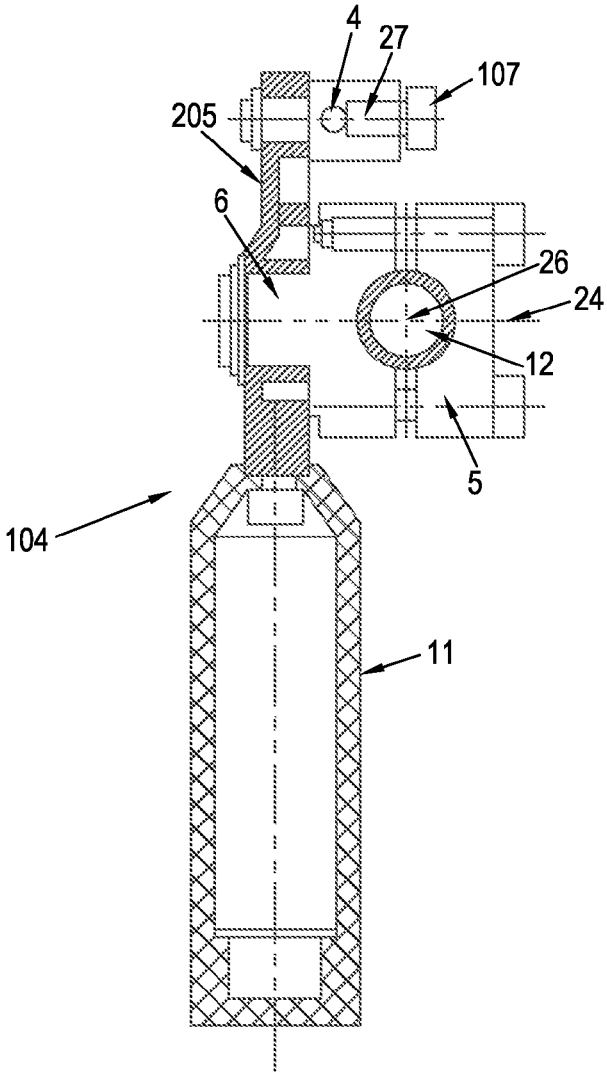
FIG. 2 is a cross-sectional view along lines A-A of FIG. 1.
Figure 4:
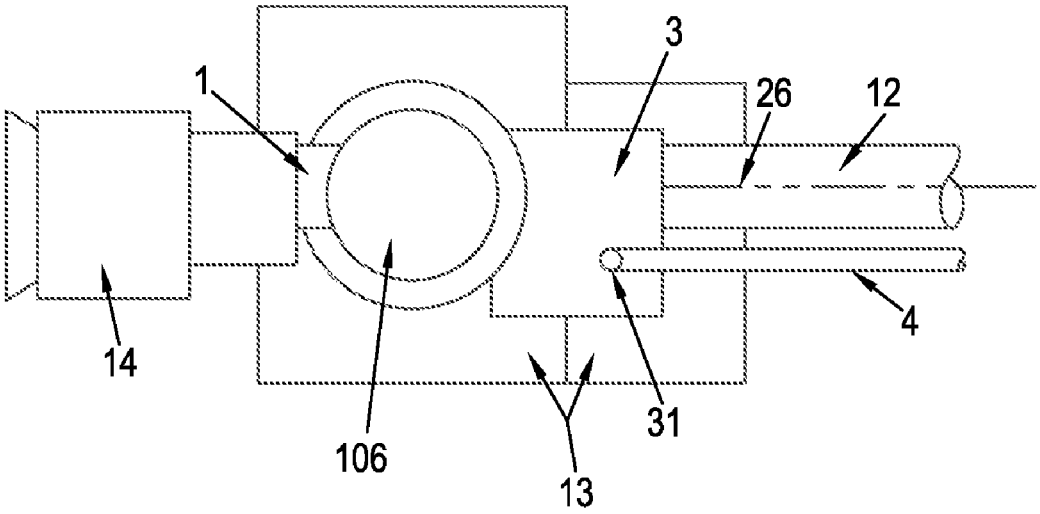
FIG. 4 is a top view of the spray nozzle structure of FIG. 1 taken along lines C-C of FIG. 1.

The described mechanical structure thus controls the angle of rotation of the swinging spray nozzle 1 as follows. Turning the assist handle 11 causes rotation of handle extension structure 205 around axle 6. This causes the axle 7 to rotate around its center of rotation axis 24 through the same angular degrees of rotation as the handle and also to rotate about axis 25. In this illustrated embodiment, the handle 11 has 90° range of motion, 45° on either side of a vertical axis as illustrated in FIG. 1. As axle 7 rotates about axis 24, it also, due to the constraint imposed by lever 4, rotates about axis 25. As axle 7 rotates about axis 24, the lever 4 thus moves backward or forward in substantially a wand axial direction, (opposite to the movement of the handle, and in the general direction of wand axis 26). The connection of lever 4, at 27, to axle 7 by screw 107 (FIG. 2 and FIG. 3) allows and requires the rotation around axis 25 to maintain mechanical integrity. The movement of the lever 4 which is connected eccentrically to the swinging plate 3 at 31 causes rotation of the swinging spray nozzle 1 about axis 106 of axle core 2. The axle core 2, as shown, provides an internal fluid connection from the output of the wand 12 to the nozzle 1, and then, for example, to a quick connecting tip 14. This rotation accounts for the rotation of the nozzle up and down or left and right, depending upon the orientation of the wand 12 about its axis 26.

The cross-sectional views along A-A and B-B provide a supplemental visualization of this operation. In addition, the top view in the direction of lines C-C illustrates the connection to the swinging plate 3 and its off axis oriented connection 31 for enabling rotation of the plate about axis 106.

Figure 5:
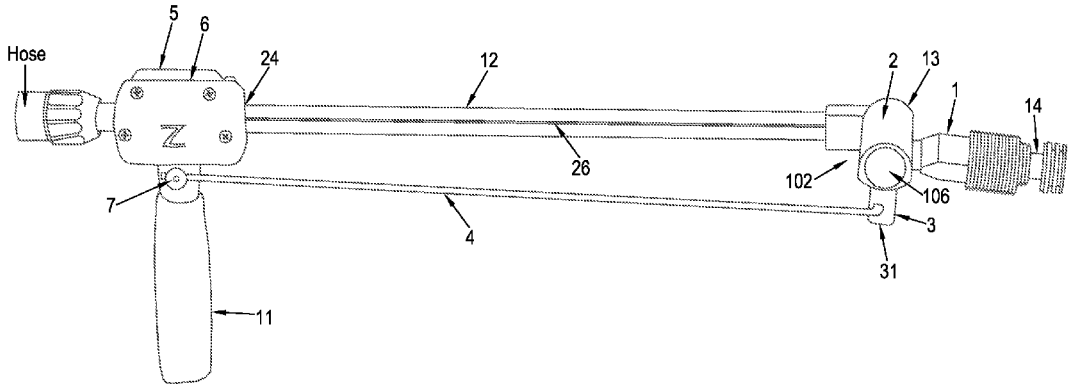
FIG. 5 is a graphic rendition of a second illustrative embodiment of the invention.

Referring to FIG. 5, there is shown a second embodiment in accordance with the invention in which the rotation of the spray nozzle 1 is in the same plane as the rotational movement of the handle 11 about its axis of rotation 24. Here also, the connection of the lever to the handle 11, as illustrated, occurs at a location on the same side of the wand 12 as the handle 11. In this embodiment, like parts have been labeled with like reference numbers as the embodiment of FIGS. 1-4.

Thus, as the handle rotates back and forth around axis 24 in the general direction of the wand axis 26, the swinging plate 3 also moves in substantially the same plane as it rotates about its center rotation axis 106, and the spray nozzle section 102 rotates nozzle 14 up and down about axis 106 in the same plane as well.

Figure 6:
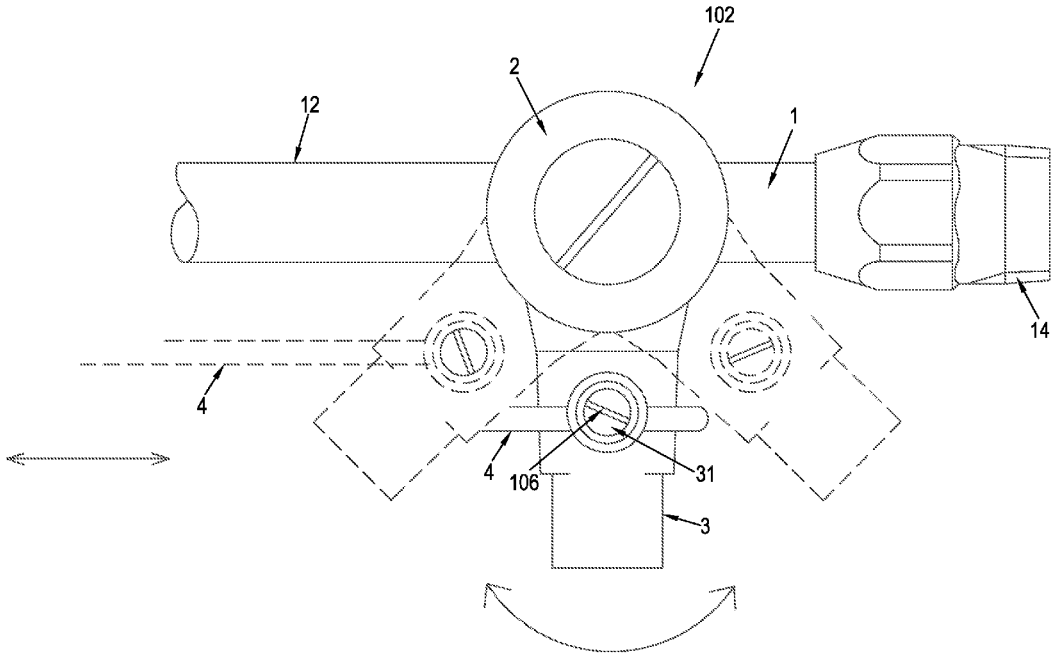
FIG. 6 is a side view of the spray nozzle structure of the embodiment of FIG. 5.

Referring to FIG. 6, there is illustrated an enlarged drawing showing the movement of the swinging plate 3 as it rotates about its center of axis. (Note that here, the corresponding movement of the spray nozzle 1 has not been shown although the nozzle would move a like number of degrees around its center of axis, for this is illustrative example, as the swinging plate 3 moves about the same axis (in this embodiment).)

The flexible spray system thus has several advantageous features. First, it provides a structure which enables movement of the swinging spray nozzle 1 without leaking (using seals 110 around base 13), as high pressure water passes from the wand 12 to the spray nozzle 1; and second, it provides a construction which has a small resistance (the spring 10 loaded (through mandrel 9) ball 8 residing in indents 22) to handle movement, so that the swinging spray nozzle 1 will not shift angles due to counterforces from the high pressure water. This allows use of the flexible spray system described herein to spray at a certain set angle for a prolonged period, in a practical, reliable and convenient manner.

Other objects and features of the invention will be apparent to those practiced in this field and are within the scope of the following claims.

What is claimed is:

1. A swivel nozzle mechanism for use with a high pressure fluid washer, the washer having an output wand connected through a hose to a fluid output of the washer, the output wand having a proximal end and a distal end, the swivel nozzle mechanism comprising:

a handle mechanism connecting to the wand near the proximal end, for moving an axial lever linkage in the general direction of a wand axis that extends longitudinally between the proximal end and the distal end of the wand;

a swivel mechanism connecting to the distal end of the wand, the swivel mechanism comprising a rotatable nozzle having an axis of rotation;

a rotation inducing structure integral with the rotatable nozzle, the inducing structure having a connection that is off axis with respect to the axial lever linkage; and a support base connected to the wand and supporting the rotatable nozzle, and providing a fluid flow path from a wand output orifice to the nozzle;

the handle mechanism comprising a fixed support structure connected to the wand in fixed orientation;

a rotatable hub rotatably secured to the support structure;

the axial lever linkage rotatably connecting to the rotatable hub of the handle mechanism through a rotatable axle;

the axle having a rotatable connection with the hub and connected to the lever linkage to enable lever linkage movement about an axis normal to a lever linkage axis;

the hub being rotatable about a hub axis normal to the wand axis; and a handle connected to the hub, the handle being able to rotate the hub about the hub axis for a limited rotational extent, thereby to rotate the hub about said hub axis by the same rotational extent;

the rotatable hub having a plurality of stops; and a handle retention mechanism for enabling the handle to be maintained in a selectable rotational position using said stops, resistant to forces attempting to cause said handle to rotate; and whereby rotational movement of said handle about said hub axis causes the lever linkage mechanism to move in a direction to cause the rotatable nozzle to rotate about its axis of rotation.

2. The swivel nozzle mechanism of claim 1 wherein the handle mechanism further comprises a plurality of indents on a circular peripheral section of said rotatable hub, a spring-loaded ball shaped element sized to fit said indents, said ball shaped element acting to inhibit rotational movement of said hub relative to said spring-loaded ball, said ball being contained within a structure integrally connected with said fixed support structure.

3. The swivel nozzle mechanism of claim 1 wherein said rotation inducing structure comprises a swinging plate structure having a connection point to which said axial lever linkage connects, and said axial lever linkage connecting between the swinging plate structure and the rotatable axle maintained within an extension of said hub.

4. The swivel nozzle mechanism of claim 1 wherein said output wand is composed of a solid metallic material.

5. The swivel nozzle mechanism of claim 1 further comprising a plurality of seal elements around the support base.

6. The swivel nozzle mechanism of claim 1 further wherein said rotatable hub comprises a handle support section and a lever support extension section, said two support sections being 180° apart around the rotational axis of the rotatable hub.

7. The swivel nozzle mechanism of claim 3, wherein the connection point that connects the swinging plate structure to the axial lever linkage is substantially off axis with respect to the wand axis.

* * * * *